US008770642B1

(12) United States Patent
Jason

(10) Patent No.: US 8,770,642 B1
(45) Date of Patent: Jul. 8, 2014

(54) EVIDENCE COLLECTION DEVICE

(71) Applicant: Alexander Jason, Pinole, CA (US)

(72) Inventor: Alexander Jason, Pinole, CA (US)

( * ) Notice: Subject to any disclaimer, the term of this patent is extended or adjusted under 35 U.S.C. 154(b) by 0 days.

(21) Appl. No.: 13/746,142

(22) Filed: Jan. 21, 2013

(51) Int. Cl.
*B25B 9/02* (2006.01)

(52) U.S. Cl.
USPC ..... 294/99.2; 294/93; 294/212

(58) Field of Classification Search
USPC ..... 294/3, 5, 93, 99.2, 1.2; 24/565; 81/6, 7, 81/8
See application file for complete search history.

(56) References Cited

U.S. PATENT DOCUMENTS 714,310 A * 11/1902 Laws ..... 30/151
849,789 A * 4/1907 Hurd ..... 294/99.2
2,451,994 A * 10/1948 Towns ..... 604/48
2,492,576 A * 12/1949 James ..... 81/111
4,037,866 A * 7/1977 Price ..... 294/1.2
D253,974 S * 1/1980 Nalbandian ..... D28/55
5,421,629 A * 6/1995 Karban ..... 294/99.2
6,896,741 B2 * 5/2005 Stelcher ..... 134/6
2012/0097575 A1 * 4/2012 Abel et al. ..... 206/576

* cited by examiner

*Primary Examiner* — Dean Kramer
(74) *Attorney, Agent, or Firm* — Donald J. Ersler

(57) ABSTRACT

An evidence collection device preferably includes a handle member and a container member. The handle member preferably includes an evidence retention device and a handle portion. The evidence retention device preferably includes at least one loop, a first arm and a second arm. First and second clearance slots are formed in the handle portion to provide clearance for the first and second arms. A retention dowel is inserted through the at least one loop and into the handle portion to retain the evidence retention device. The container member is sized to receive the handle portion. A tapered surface is preferably formed on one end of the handle portion. In use, the first and second arms are squeezed together with two fingers for insertion into a cartridge casing. The one end of the handle portion is inserted into the container member and retained by friction.

15 Claims, 3 Drawing Sheets

EVIDENCE COLLECTION DEVICE

BACKGROUND OF THE INVENTION

1. Field of the Invention

The present invention relates generally to the science of forensics and more specifically to an evidence collection device, which allows a cartridge casing or other evidence to be collected and stored without compromising DNA or other trace evidence.

2. Discussion of the Prior Art

The collection of fired cartridge casings is commonly done with gloved hands, tweezers, or other simple objects. It appears that no tool or device exists specifically for this purpose. It is important to note that a pencil or chopstick or similar item can be used to pickup a cartridge casing from the inside, these "tools" do not retain the cartridge casing and do not provide any way to safely transport and store the cartridge casing. Typically, once the cartridge casing is collected (usually from the floor or ground at a crime scene), the cartridge casing is dropped into a paper "coin" envelope or placed into a small, cotton filled box. Recent research has established that these methods can be destructive to trace evidence. The handling of cartridge casings with gloved hands will remove a substantial amount of DNA evidence and other trace evidence (fibers, hairs, etc). Further, the currently used envelope and box used for transporting and storing the casings also can remove DNA and other trace evidence from the casing. It appears that the closest prior art is a state of the art method for transporting a knife from a crime scene. A foam block is inserted into one end of a plastic tube. A tip of the blade of the knife is stuck into the foam block.

Recent technological advances has made the use of "touch" DNA as evidence practical and effective in processing crime scenes and other areas of forensic interest. When an object is handled, microscopic elements of skin cells and body liquids are often transferred to objects such as fired and unfired cartridge casings. While highly valuable for DNA identification, this minute evidence is also extremely fragile. DNA and other trace evidence can be readily rubbed off or cross contaminated by handling the cartridge casing with a glove, or storing and transporting the cartridge casing with current methods and tools.

Accordingly, there is a clearly felt need in the art for a evidence collection device, which allows a cartridge casing to be collected in a manner that will prevent the destruction or degradation of DNA and other trace evidence; which allows a cartridge casing to be picked up from an inner perimeter, while not compromising DNA and other trace evidence and which protects the user from being contaminated with potentially hazardous materials or substances, such as blood diseases.

SUMMARY OF THE INVENTION

The present invention provides an evidence collection device, which allows a cartridge casing or other evidence to be collected and stored without compromising DNA or other trace elements. The evidence collection device preferably includes a handle member and a container member. The handle member preferably includes an evidence retention device and a handle portion. The evidence retention device is preferably a tweezers device. The tweezers device is preferably fabricated from a single piece of spring steel wire. However, other tweezers designs or other evidence retention devices may also be used. Substantially a middle of the wire is bent to form at least one loop. A first tweezers arm extends from a first end of the at least one loop and a second tweezers arm extends from a second end of the at least one loop. Substantially an end of the first tweezers arm is offset inward to form a first offset portion. Substantially an end of the second tweezers arm is offset inward to form a second offset portion. The end of the first tweezers arm is bent outward to form a first hook and the end of the second tweezers arm is bent outward to form a second hook.

A first clearance slot is formed in one side and one end of the handle portion to provide clearance for the first tweezers arm. A second clearance slot is formed in an opposing side and the one end of the handle portion to provide clearance for the second tweezers arm. A dowel hole is formed through the handle portion, substantially perpendicular to the first and second clearance slots. A through slot is formed through an end of the first and second clearance slots to provide clearance for the at least one loop. A retention dowel is inserted into the dowel hole and through the at least one loop to retain the tweezers device. The evidence retention device may also be an adhesive tipped rod. The container member includes an inner perimeter, which is sized to receive an outer perimeter of the handle portion. A perimeter of the one end of the handle portion preferably includes a tapered surface, such that the handle portion is retained in the inner perimeter by friction, when inserted into the container member.

In use, the first and second tweezers arms are squeezed together with two fingers, such that the first and second hooks may be inserted into an inner perimeter of a cartridge casing. The first and second hooks are inserted into the cartridge casing and the two fingers are released, while the hand and remaining three fingers grasp an outer perimeter of the handle portion. The other hand is used to hold the container member. The one end of the handle portion is inserted into the container member, such that the one end of the handle portion is retained by the force fit of the tapered surface. The cartridge casing is suspended in container member without touching the walls thereof. The suspension of the cartridge casing in the container member prevents DNA and trace evidence from being rubbed-off or contaminated during storage and transport.

The evidence retention device may also be an adhesive tipped rod. The adhesive tipped rod includes an elongated rod. An adhesive is applied to an end of the elongated rod and/or an end perimeter of the elongated rod. A perimeter of the elongated rod is smaller than an inner perimeter of the cartridge casing. The elongated rod extends from an end of the handle portion. In use, the elongated rod is inserted into the inner perimeter of the cartridge casing to retain the cartridge casing thereupon. The cartridge casing is then inserted into the container member and the handle member is secured to the container member.

Accordingly, it is an object of the present invention to provide an evidence collection device, which allows a cartridge casing to be collected in a manner that will prevent the destruction or degradation of DNA and other trace evidence.

It is a further object of the present invention to provide an evidence collection device, which allows a cartridge casing to be picked up from an inner perimeter, while not compromising DNA and other trace evidence.

Finally, it is another object of the present invention to provide an evidence collection device, which protects the user from being contaminated with potentially hazardous materials or substances, such as blood diseases.

These and additional objects, advantages, features and benefits of the present invention will become apparent from the following specification.

DETAILED DESCRIPTION OF THE PREFERRED EMBODIMENTS

Figure 5:
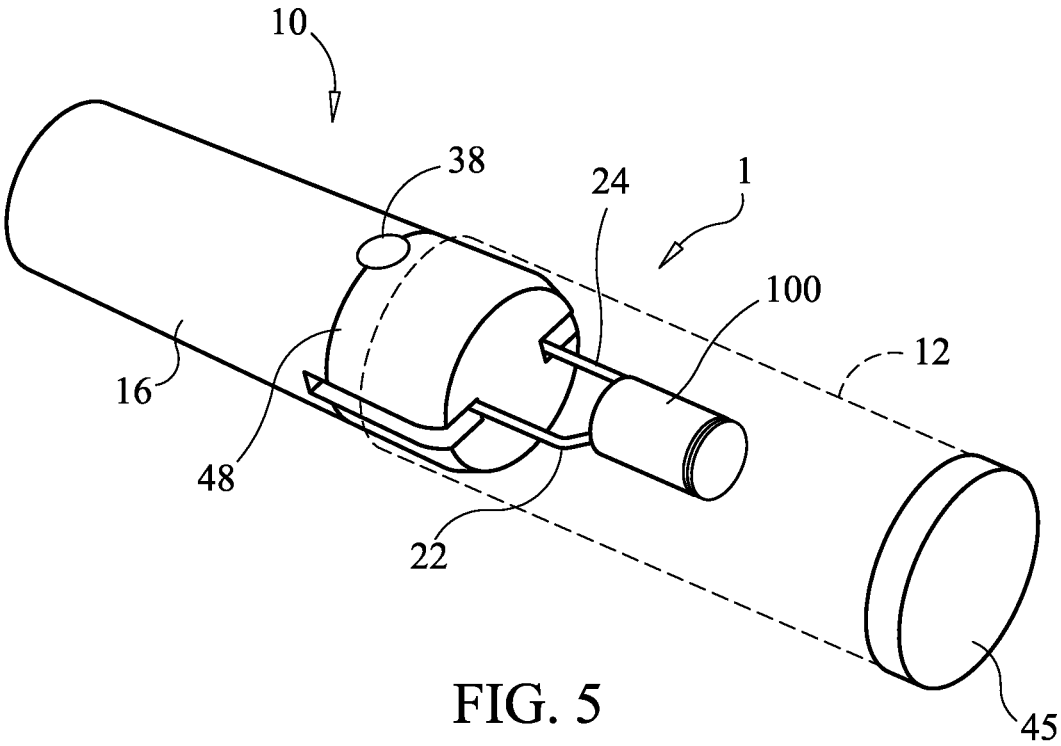
FIG. 5 is a perspective view of a handle member retained in a collection member of an evidence collection device in accordance with the present invention.

With reference now to the drawings, and particularly to FIG. 5, there is shown a perspective view of an evidence collection device 1. With reference to FIGS. 1-4, the evidence collection device 1 preferably includes a handle member 10 and a container member 12. The handle member 10 preferably includes a evidence retention device and a handle portion 16. The evidence retention device is preferably a tweezers device 14. The tweezers device 14 is preferably fabricated from a single piece spring steel wire 18. However, other tweezers designs or other cartridge casing retention devices may also be used. Substantially a middle of the wire 18 is bent to form at least one loop 20. A first tweezers arm 22 extends from a first end of the at least one loop 20 and a second tweezers arm 24 extends from a second end of the at least one loop 20. Substantially an end of the first tweezers arm 22 is offset inward to form a first offset portion 26. Substantially an end of the second tweezers arm 24 is offset inward to form a second offset portion 28. The end of the first tweezers arm 22 is bent outward to form a first hook 30 and the end of the second tweezers arm 24 is bent outward to form a second hook 32. A first gripping tube 34 may be slid over the first tweezers arm 22. A second gripping tube 36 may be slid over the second tweezers arm 24.

The handle portion 16 preferably includes a retention dowel 38. A first clearance slot 40 is formed in one side and one end of the handle portion 16 to provide clearance for the first tweezers arm 22. A second clearance slot 42 is formed in an opposing side and the one end of the handle portion 16 to provide clearance for the second tweezers arm 24. A dowel hole 44 is formed through the handle portion 16, substantially perpendicular to the first and second clearance slots 40, 42. A through slot 46 is formed through an end of the first and second clearance slots 40, 42 to provide clearance for the at least one loop 20. The retention dowel 38 is inserted into the dowel hole 44 and through the at least one loop 20 to retain the tweezers device 14.

The retention device could also be any suitable pick-up device, which has at least two arms that expand outward to retain an object and can be locked in position. A rod is pulled, pushed or twisted to expand the at least two arms outward within an inner perimeter of a cartridge casing 100 and then locked in place. The at least two arms could also be normally biased outward and retracted to insert into the inner perimeter of the cartridge casing 100. Further, the retention device could also include a perimeter, which is expanded, after insertion into the inner perimeter of the cartridge casing 100. Pick-up devices are well known in the art and need not be explained in further detail.

The container member 12 includes an inner perimeter and a bottom 45. The container member 12 is preferably fabricated from a clear, translucent or opaque plastic material, but other materials may also be used. The inner perimeter is sized to receive an outer perimeter of the handle portion 16. A perimeter of the one end of the handle portion 16 preferably includes a tapered surface 48, such that the handle portion 16 is retained in the inner perimeter of the handle portion 16 by friction, when inserted into the container member 12. However, other structures and methods may be used to secure the handle member 10 to the container member 12, besides the tapered surface 48.

In use, the first and second tweezers arms 22, 24 are squeezed together with two fingers, such that the first and second hooks 30, 32 may be inserted into an inner perimeter of a cartridge casing 100. The first and second hooks 30, 32 are inserted into the cartridge casing 100 and the two fingers are released, while the hand and remaining three fingers grasp an outer perimeter of the handle portion 16. The other hand is used to hold the container member 12. The one end of the handle portion 16 is inserted into the container member 12, such that the one end of the handle portion 16 is retained by the force fit of the tapered surface 48. The cartridge casing 100 is suspended in container member 12 without touching the inner perimeter thereof. The suspension of the cartridge casing 100 in the container member 16 prevents trace evidence from being rubbed-off or contaminated during storage or transport.

Figure 1:
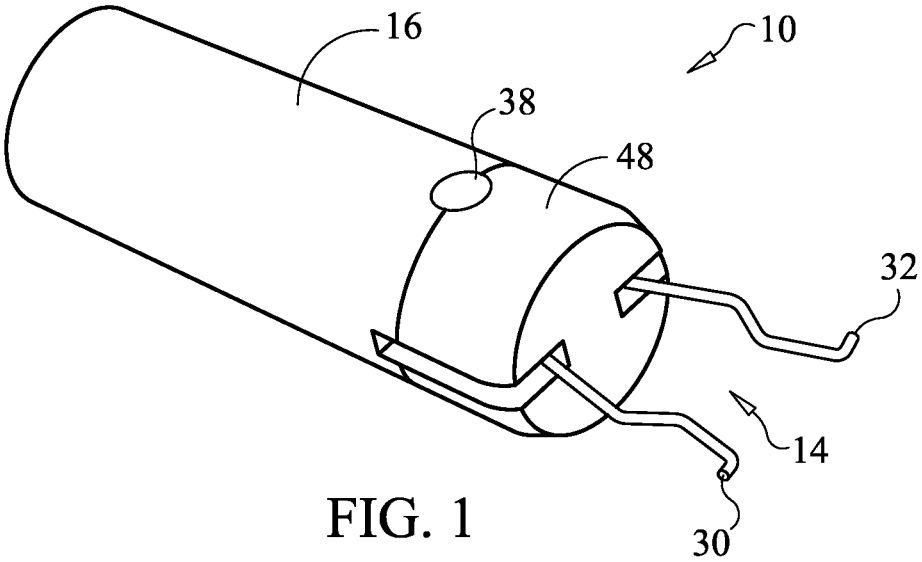
FIG. 1 is a perspective view of a handle member of an evidence collection device in accordance with the present invention.
Figure 1A:
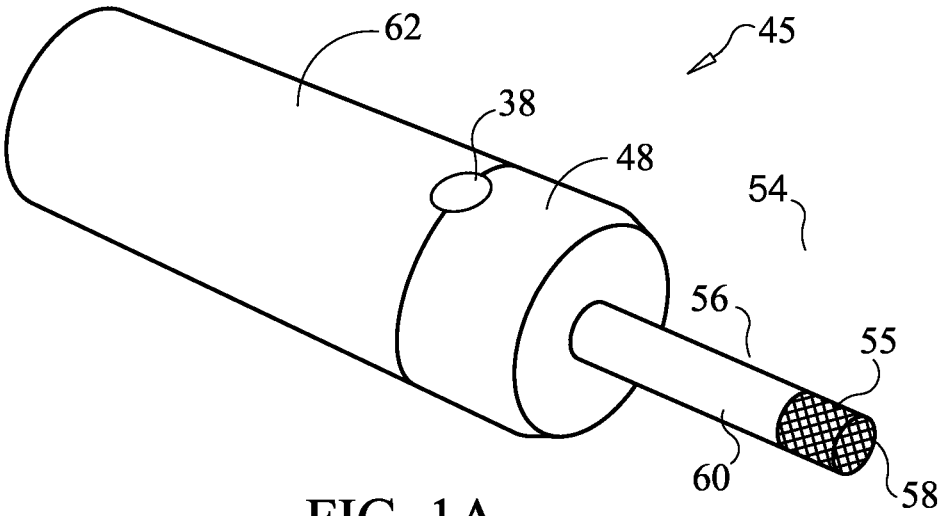
FIG. 1*a* is a second embodiment of a handle member of an evidence collection device in accordance with the present invention.
Figure 2:
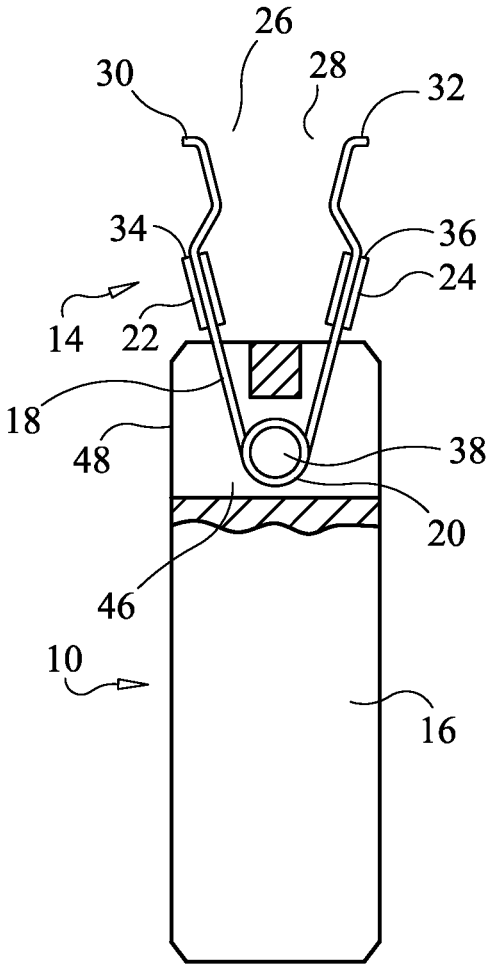
FIG. 2 is a side view of a handle member with a cutaway revealing a tweezers device of an evidence collection device in accordance with the present invention.
Figure 3:
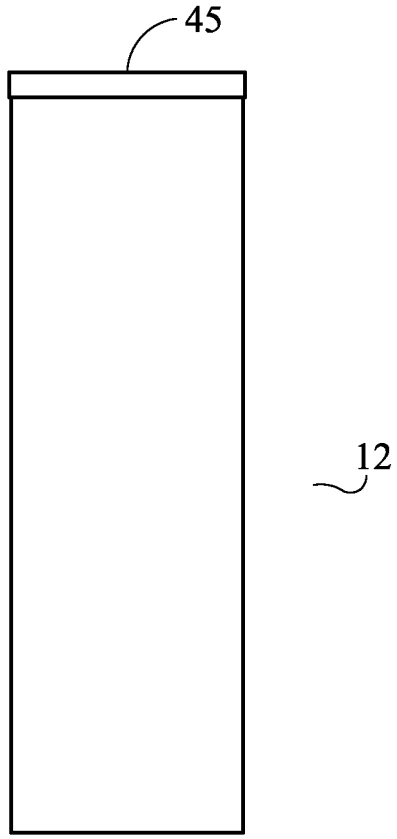
FIG. 3 is a side view of a collection member of an evidence collection device in accordance with the present invention.
Figure 4:
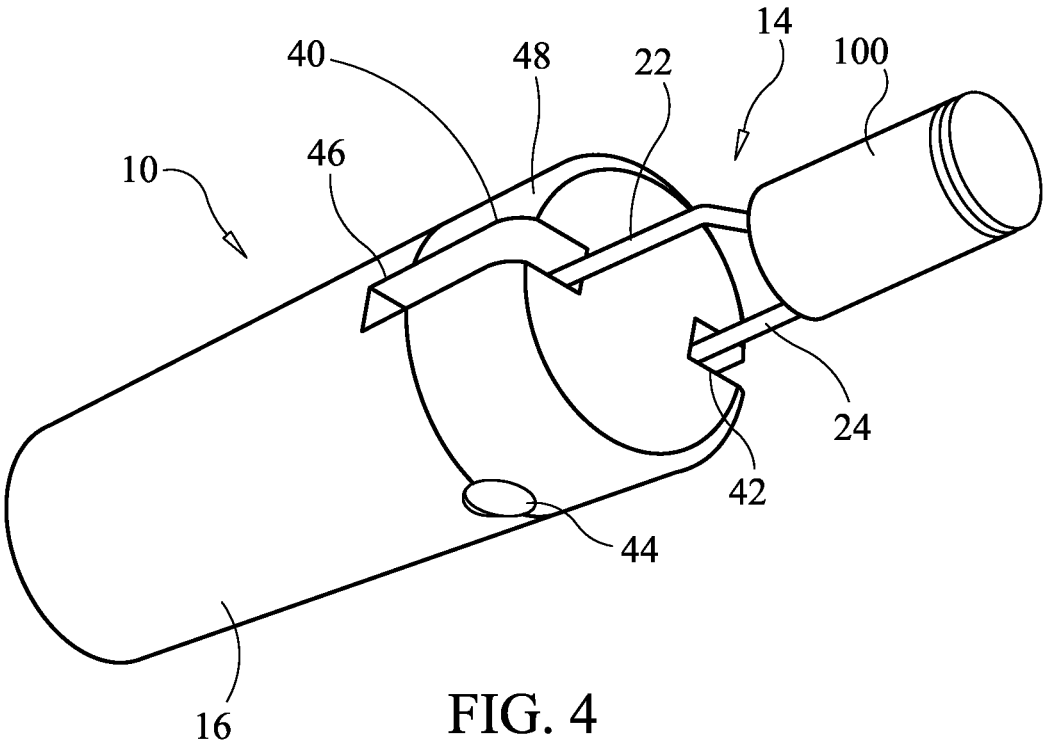
FIG. 4 is a perspective view of a handle member retaining a cartridge casing of an evidence collection device in accordance with the present invention.

With reference to FIG. 1*a*, the evidence retention device may also be an adhesive tipped rod 54. The adhesive tipped rod 54 includes an elongated rod 56. An adhesive 55 is applied to an end 58 of the elongated rod 56 and/or an end perimeter 60 of the elongated rod 56. A perimeter of the elongated rod 56 is smaller than an inner perimeter of the cartridge casing 100. The elongated rod 56 extends from an end of a handle portion 62 of a handle member 45. The retention dowel 38 is inserted into the handle portion 62. In use, the elongated rod 56 is inserted into the inner perimeter of the cartridge casing 100 to retain the cartridge casing 100 thereupon. The cartridge casing 100 is then inserted into the container member 12 and the handle member 45 is secured to the container member 12.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. An evidence collection device comprising:

a handle member includes an evidence retention device and a handle portion, said evidence retention device extends from said handle portion, said retention device includes a first arm and a second arm, a distal end of said first arm is biased away from a distal end of said second arm, said distal end of said first arm is bent to form a first hook, said distal end of said second arm is bent to form a second hook, a portion of said first hook extends inward past an axially line of said first arm, wherein said evidence retention device retains an inner perimeter of a cylindrical object; and a container member includes an inner perimeter and a bottom, a portion of said handle member is secured to a portion of said container member to retain the cylindrical object in said inner perimeter of said container member.

2. The evidence collection device of claim 1 wherein:

a first clearance slot is formed in one side of said handle portion to provide clearance for said first arm, a second clearance slot is formed in an opposing side of said handle portion to provide clearance for said second arm.

3. The evidence collection device of claim 1 wherein:

a tapered surface is formed on one end of said handle portion, wherein said one end of said handle portion is inserted into said inner perimeter of said container member, said handle portion is secured in said container member by friction.

4. The evidence collection device of claim 1 wherein:

said container member is fabricated from one of a clear, translucent and opaque material.

5. The evidence collection device of claim 1 wherein:

an end of said first hook does not extend outward past an axially line of said first arm.

6. An evidence collection device comprising:

a handle member includes an evidence retention device and a handle portion, said handle portion is structured to be retained by at least one hand, said evidence retention device extends from said handle portion, said evidence retention device includes a first arm and a second arm, a distal end of said first arm is biased away from a distal end of said second arm, said distal end of said first arm is bent to form a first hook, said distal end of said second arm is bent to form a second hook, a portion of said first hook extends inward past an axially line of said first arm, wherein said evidence retention device retains an inner perimeter of a cylindrical object; and a container member includes an inner perimeter and a bottom, a portion of said handle member is secured to a portion of said container member to retain the cylindrical object in said inner perimeter of said container member.

7. The evidence collection device of claim 6 wherein:

a first clearance slot is formed in one side of said handle portion to provide clearance for said first arm, a second clearance slot is formed in an opposing side of said handle portion to provide clearance for said second arm.

8. The evidence collection device of claim 6 wherein:

a tapered surface is formed on one end of said handle portion, wherein said one end of said handle portion is inserted into said inner perimeter of said container member, said handle portion is secured in said container member by friction.

9. The evidence collection device of claim 6 wherein:

said container member is fabricated from one of a clear, translucent and opaque material.

10. The evidence collection device of claim 6 wherein:

an end of said first hook does not extend outward past an axially line of said first arm.

11. An evidence collection device comprising:

a handle member includes an evidence retention device and a handle portion, said evidence retention device extends from said handle portion, said evidence retention device includes a first arm and a second arm, a distal end of said first arm is biased away from a distal end of said second arm, said distal end of said first arm is bent to form a first hook, said distal end of said second arm is bent to form a second hook, a portion of said first hook extends inward past an axially line of said first arm, said first and second arms are fabricated from a single piece of wire, wherein said evidence retention device retains an inner perimeter of a cylindrical object; and a container member includes an inner perimeter and a bottom, a portion of said handle member is secured to a portion of said container member to retain the cylindrical object in said inner perimeter of said container member.

12. The evidence collection device of claim 11 wherein:

a first clearance slot is formed in one side of said handle portion to provide clearance for said first arm, a second clearance slot is formed in an opposing side of said handle portion to provide clearance for said second arm.

13. The evidence collection device of claim 11 wherein:

a tapered surface is formed on one end of said handle portion, wherein said one end of said handle portion is inserted into said inner perimeter of said container member, said handle portion is secured in said container member by friction.

14. The evidence collection device of claim 11 wherein:

said container member is fabricated from one of a clear, translucent and opaque material.

15. The evidence collection device of claim 11 wherein:

an end of said first hook does not extend outward past an axially line of said first arm.

* * * * *